US005223121A

United States Patent [19]

Dickie et al.

[11] Patent Number: 5,223,121

[45] Date of Patent: Jun. 29, 1993

[54] PROTECTIVE CARTON WITH PROGRESSIVE PRODUCT CLAMPING

[76] Inventors: Robert G. Dickie, 15 Valley Trail, RR #2, Newmarket, Ontario L3Y 4V8; Michael J. Phillips, 1906 Barsuda Drive, Mississauga, Ontario L5J 1V5; Brian J. Walters, Rural Route #1, Sunderland, Ontario L0C 1H0, all of Canada

[21] Appl. No.: 694,622

[22] Filed: May 2, 1991

[51] Int. Cl.[5] ..... B65D 81/02

[52] U.S. Cl. ..... 206/591; 220/416; 229/120.11; 206/334

[58] Field of Search ..... 206/334, 328, 454, 521, 206/591; 220/416; 229/120.11, 120.12, 120.18, 120.21

[56] References Cited

U.S. PATENT DOCUMENTS

| | | | |
|---|---|---|---|
| 2,177,241 | 10/1939 | Burack | 206/454 |
| 2,401,765 | 6/1946 | Kuhlman | 206/521 X |
| 3,059,830 | 10/1962 | Kramer | 206/334 X |
| 3,383,028 | 5/1968 | Brander | 206/454 X |
| 3,921,890 | 11/1975 | Reihm | 206/454 |
| 4,498,420 | 2/1985 | Botterman et al. | 229/120.21 X |
| 4,609,104 | 9/1986 | Kasper et al. | 206/328 X |
| 5,002,188 | 3/1991 | Dickie | 206/589 |
| 5,049,710 | 9/1991 | Prosise et al. | 229/120.21 X |
| 5,088,601 | 2/1992 | Seefeldt | 206/334 |

*Primary Examiner*—Jimmy G. Foster
*Assistant Examiner*—Beth Anne Cicconi

[57] ABSTRACT

A protective carton for a substantially flat product such as an electrical printed circuit board includes not only parallel rectangular exterior top and bottom panels, parallel rectangular exterior side panels, and parallel rectangular exterior end panels but also rectangular interior top and bottom panels and at least a pair of rectangular interior end panels. Each of the interior end panels forms an acute angle with respect to the interior bottom panel in order to clamp the product securely in place on the interior bottom panel. Each interior end panel is formed by lateral extensions of the interior top and bottom panels, with the lateral extensions of the interior top panels locking the lateral extensions of the interior bottom panel in place. The entire carton may be made of a material such as corrugated cardboard in order to minimize cost and facilitate eventual disposal.

16 Claims, 2 Drawing Sheets

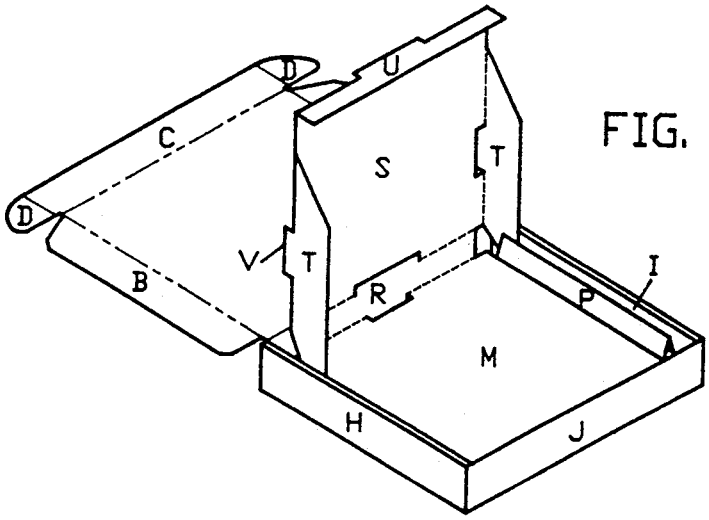
FIG. 2
FIG. 3
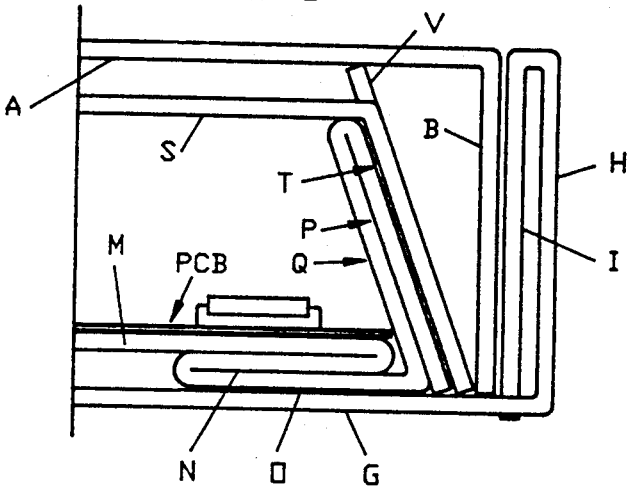
FIG. 4
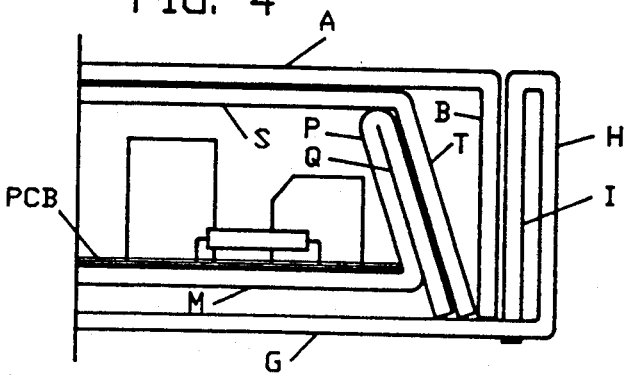

PROTECTIVE CARTON WITH PROGRESSIVE PRODUCT CLAMPING

TECHNICAL FIELD

This invention relates generally to collapsible shipping cartons and more particularly to collapsible cartons with inner portions which provide additional protection for shipping relatively light weight but fragile products.

BACKGROUND OF THE INVENTION

When shipping small and light weight but fragile products, it is desirable not only to provide packaging protection which is as complete as possible but also to minimize both packaging and shipping costs. In minimizing packaging costs, it is becoming increasingly important to avoid the use of environmentally disadvantageous materials such as foams wherever possible.

In the past, a common approach in the packaging of such products as electrical printed circuit boards, which are essentially flat but have multiple electrical components mounted upon them, has been to box them in on all sides, using foam slabs within an outer cardboard carton. For larger and heavier printed circuit boards, because it is important to avoid placing pressure directly upon the electrical components, common practice has been to use foam that can deform to the contours of the components. Foam tends, unfortunately, not only to be relatively expensive to produce but also to create environmental problems related to its eventual disposition. It is advantageous, both from the standpoint of initial cost and from that of eventual disposition, if a material such as corrugated cardboard can be used both as an outer carton and also to provide the necessary interior support and protection.

SUMMARY OF THE INVENTION

The invention generally takes the form of a protective and support carton for a substantially flat product. The outside of the carton is made up, conventionally, of parallel rectangular exterior top and bottom panels, a pair of parallel rectangular exterior side panels, and a pair of parallel rectangular end panels. To provide both protection and support for a substantially flat product such as a printed circuit board, the invention features at least rectangular interior top and bottom panels and a pair of rectangular interior end panels. In particular, each of the interior end panels forms an acute angle with respect to the interior bottom panel. In this manner, the interior end panels securely clamp a product supported by the interior bottom panel without touching any components which may happen be mounted upon it. The entire package may be fabricated of corrugated cardboard, minimizing cost and facilitating disposal when the package is no longer needed.

In a package constructed in accordance with the principles of the invention, the two interior end panels may, in addition, hold at least one of the interior top and bottom panels apart from its corresponding outer panel. The interior bottom panel may be held apart from the exterior bottom panel or, alternatively, both of the interior top and bottom panels may be held apart from their corresponding exterior panels.

In one important aspect, the invention takes the form of the package which has just been described, in which the lateral dimension of the interior top panel between the interior end panels is shorter than the corresponding lateral dimension of the interior bottom panel. In this manner, the magnitude of the acute angle of the interior end panel with respect to the interior bottom panel is fixed with a high degree of accuracy, ensuring that a supported product will be clamped securely at both ends upon the interior bottom panel.

A feature of many embodiments of the invention is that the interior end panels are both formed by lateral extensions of at least one of the interior top and bottom panels. In those embodiments in which the interior end panels are formed by lateral extensions of both the top panel and the bottom panel, the lateral extension of the interior top panel is folded between the lateral extension of the interior bottom panel and the corresponding exterior end panel. In this arrangement, each acute angle between an interior end panel and the interior bottom panel is determined by the interior top panel and its lateral extension, while the interior end panels themselves are progressively clamped or wedged in position by the lateral extensions of the interior bottom panel. The fold lines at each end of the interior bottom panel at the beginning of the interior end panel lateral extension serve as pivots for the clamping actions which hold a product mounted upon the interior bottom panel in position. At the same time, at each end of the interior top panel, the top of the lateral extension of the interior bottom panel is near the pivot formed by the lateral fold line between the interior top panel and its own lateral extension. The mechanical advantage thereby produced ensures maintenance of the acute angle between each interior end panel and the interior bottom panel. In other words, each lateral extension of the interior bottom panel clamps the product in place by setting the angle and each lateral extension of the interior top panel progressively clamps or wedges the entire assembly in position.

Still another feature of a number of embodiments of the invention is that, at each end of the interior bottom panel, a lateral extension thereof between the interior bottom panel and the corresponding interior panel is folded under the interior bottom panel to hold the interior bottom panel apart from the exterior bottom panel. Alternatively, or in addition, at each end of the interior top panel a tab formed from the lateral extension thereof may be used to hold the interior top panel apart from the exterior top panel. In an alternative arrangement featured by the invention, at each end of the interior bottom panel the ends of the lateral extensions of both of the interior top and bottom panels hold the interior bottom panel apart from the exterior bottom panel.

The invention may be better understood from the following more detailed description of a specific embodiment and an alternative arrangement, taken in the light of the accompanying drawing and the appended claims.

BRIEF DESCRIPTION OF THE DRAWINGS

A complete understanding of the present invention may be gained by considering the following detailed description in conjunction with the accompanying drawings, in which:

FIG. 2 is a perspective view of the corrugated cardboard form of FIG. 1 in partially assembled form;

FIG. 3 is a cross section view of one end of an assembled cardboard form embodying features of the invention and showing one manner of suspending the interior top and bottom panels apart from the exterior top and bottom panels; and FIG. 4 is a cross section view of the same end of an assembled cardboard form embodying features of the invention and showing an alternative manner of suspending the interior top and bottom panels apart from the exterior top and bottom panels.

To facilitate reader understanding, identical reference numerals are used to designate elements common to the figures.

DETAILED DESCRIPTION

Figure 1:
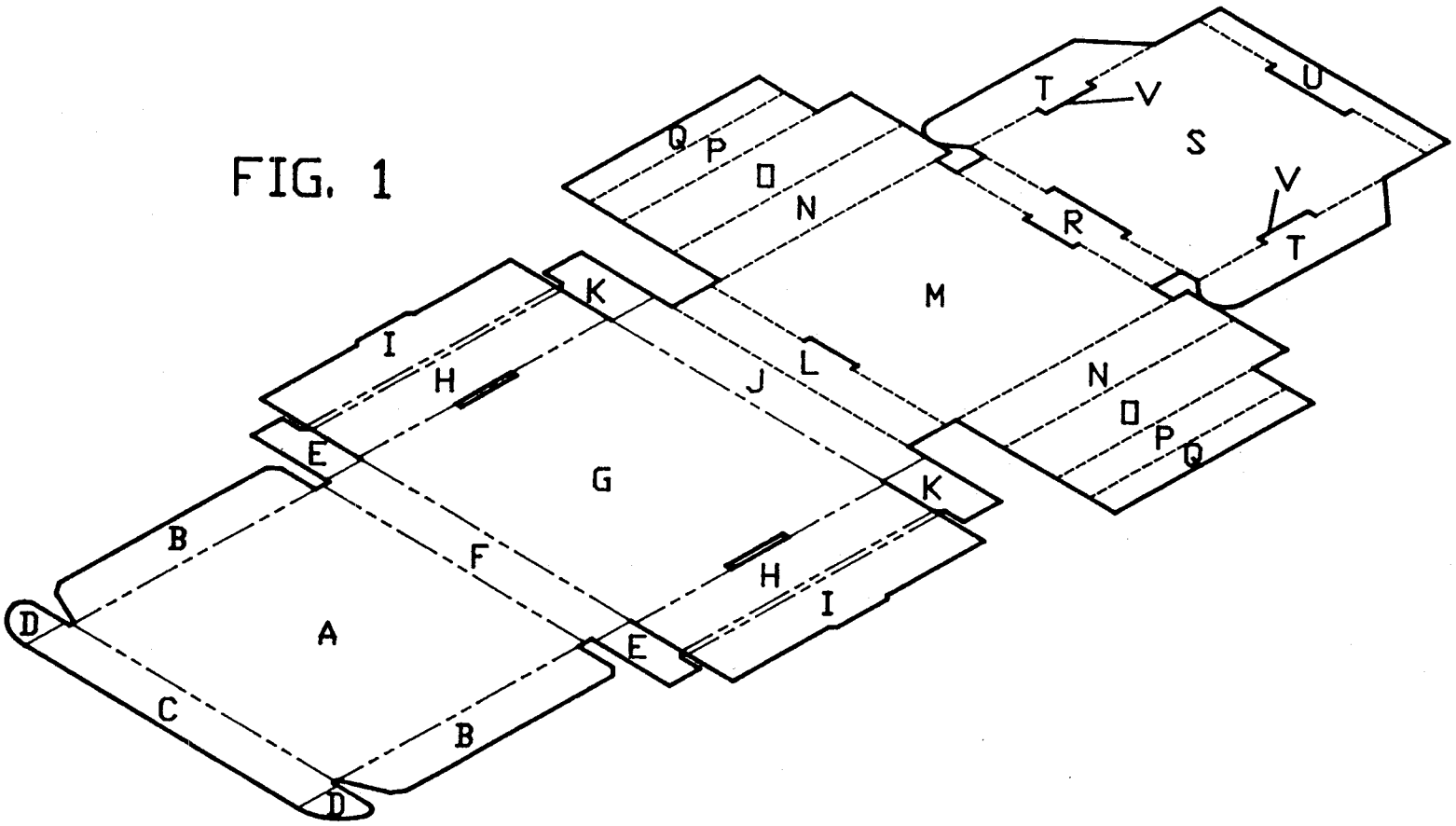
FIG. 1 is a perspective view of a unassembled corrugated cardboard form for a protection and support carton embodying various features of the invention.

The largest components of the corrugated cardboard form shown in FIG. 1 are an exterior top panel A, an exterior bottom panel G, an interior bottom panel M, and an interior top panel S. For convenience, the lengthwise dimension extending from the lower left of FIG. 1 to the upper right through panels A, G, M, and S will be referred to as longitudinal and the crosswise dimension extending from the upper left of each of those panels to the lower right will be referred to as lateral. As shown, the lateral dimensions of interior top panel S and interior bottom panel M are less than those of exterior bottom panel G and exterior top panel A. Further, the lateral dimension of interior top panel S is less than that of interior bottom panel M.

As illustrated in FIG. 1, exterior top panel A has a lateral extension B at each end in the form of a single flap, with a longitudinal fold line separating it from panel A. Exterior bottom panel G has successive lateral extensions H and I at each end. Lateral extension I is an outer flap and is separated from lateral extension H by two longitudinal fold lines, while lateral extension H is separated from panel G by another longitudinal fold line. Interior bottom panel M has successive lateral extensions N, O, P, and Q at each end, each of which is separated from the adjacent flap by a longitudinal fold line. The innermost lateral extension N is separated from panel M by another longitudinal fold line. Interior top panel S has a lateral extension T at each end in the form of a single flap with a longitudinal fold line separating it from panel S. Each lateral extension T has a centrally located tab V extending from the fold line in the direction of panel S.

Longitudinal extensions C, F, J, L, R, and U are located at the ends of the form and between respective top and bottom panels in the manner shown. At the lower left hand corner of FIG. 1, longitudinal extension C takes the form of a flap having its own single lateral extension D at each end. A lateral fold line separates longitudinal extension C from exterior bottom panel A and a longitudinal fold line separates each lateral extension D from longitudinal extension C. Between exterior top panel A and exterior bottom panel G, longitudinal extension F has its own lateral extensions E, each separated from longitudinal extension F by a lateral fold line. Longitudinal extension F is itself separated from exterior top panel A by a lateral fold line and from exterior bottom panel G by another lateral fold line.

To the upper right of exterior bottom panel G in FIG. 1, two longitudinal extensions J and L lie between exterior bottom panel G and interior bottom panel M, with respective lateral fold lines separating longitudinal extension J from exterior bottom panel G, longitudinal extension J from longitudinal extension L, and extension L from interior bottom panel M. As shown, longitudinal extension J has its own lateral extension K at each end, with a longitudinal fold line separating each lateral extension K from longitudinal extension J. Beyond interior bottom panel M, longitudinal extension R joins interior bottom panel M and interior top panel S, with respective lateral fold lines separating longitudinal extension R from interior bottom panel M and from interior top panel S. Longitudinal extension U takes the form of a flap at the upper right hand end of interior top panel S.

The corrugated cardboard form shown in FIG. 1 assembles into a protective carbon which provides progressive clamping action for holding a flat product such as an electrical printed wiring board in place on top of interior bottom panel M. The manner in which assembly takes place is illustrated by the perspective view shown in FIG. 2.

In reaching the state of partial assembly shown in FIG. 2, lateral extensions E, K, T, and U have all been folded upward from the positions shown in FIG. 1. Lateral extensions I have been folded inward over lateral extensions H and each lateral extension H has been folded upward from exterior bottom panel G. Longitudinal extensions J and L have been folded back upon one another and both have been folded upward from their respective bottom panels. Each lateral extension N has been folded under interior bottom panel M, with lateral extension O folded upward to contact the face of lateral extension N. Each lateral extension P has been folded upward and each lateral extension Q has been folded backward over lateral extension P.

As shown in FIG. 2, longitudinal extensions F and R form the outermost part of one exterior side panel of the carton and longitudinal extensions J and L form the outermost part of the other. Longitudinal extension F is hidden in FIG. 2 by longitudinal extension R and longitudinal extension L is hidden by longitudinal extension J. The outermost part of each exterior end panel of the carton is formed by lateral extensions H and I. Lateral extensions N and O support interior bottom panel M and hold it separated therefrom in a manner which will be shown in more detail in FIG. 3.

Interior bottom panel M is in its final position in FIG. 2, but interior top panel S has only been folded upward prior to final positioning. As can be seen in FIG. 2, interior top panel S will finally be folded down into position, with longitudinal extension U forming the innermost part of one side panel and longitudinal extension R the innermost part of the other. Each lateral extension T fits between lateral extension Q and lateral extension I. When exterior top panel A is folded into its final position, longitudinal extension C fits outside logitudinal extension J. Each lateral extension D fits between longitudinal extensions H and K to complete the assembly.

FIG. 3 shows more detail of one end of a fully assembled carton of the type illustrated in FIGS. 1 and 2. In FIG. 3, an electrical printed circuit board PCB is shown mounted on interior bottom panel M. Lateral extension I is folded inside of lateral extension H, while lateral extension B is folded inside of them both. Lateral extensions N and O are folded under interior bottom panel M to hold interior bottom panel M apart from exterior bottom panel G. The lateral dimension of interior top panel S is less than that of exterior top and bottom panels A and G and is less than that of interior bottom panel M. As a result, lateral extension T folds down to the end of exterior bottom panel G to make an acute angle, optimally of the order of approximately forty degrees, between itself and interior bottom panel M. Lateral extensions P and Q are folded back upon one another inside of lateral extension T to clamp printed circuit board PCB securely by its edge. Lateral extension T locks the assembly into place.

Tab V, which extends above the fold line between lateral extension T and interior top panel S, holds interior top panel S apart from exterior top panel A. The entire assembly provides enough friction to hold circuit board PCB securely in place. If circuit board PCB were to work loose, vibration caused by movement in transportation might cause circuit board PCB to cut into and weaken the outer protective packaging. Lateral extensions B of exterior top panel A serve as outer cover flaps and provide final tightening by adding still another thickness of corrugated cardboard between the inner sides of the outer carton and the clamping area. As these flaps descend vertically into the "V" created by the angled clamping area, significant sideways force is produced with very little downward force.

FIG. 4 shows details of one end of a fully assembled carton which employs an alternative folding arrangement for clamping printed circuit board PCB in place. In this arrangement, lateral extensions N and O are omitted. Lateral extension Q is longer than lateral extension P and, as a result, that portion of lateral extension Q which extends beyond the fold line between lateral extension P and interior bottom panel M holds the latter separated from exterior bottom panel G. In this alternative arrangement, interior top panel S is not held apart from exterior top panel A.

It is to be understood that the embodiments of the invention which have been described are illustrative. Numerous other arrangements and modifications may be readily devised by those skilled in the art without departing from the spirit and scope of the invention.

What is claimed is:

1. A protection and support carton for a substantially flat product assembled by folding from at least one sheet of cardboard, said at least one sheet comprising first and second rectangular panels forming, when folded, substantially parallel exterior top and bottom panels of said carton, third and fourth rectangular lateral extensions forming, when folded, substantially parallel exterior side panels of said carton, and fifth and sixth rectangular longitudinal extensions forming, when folded, substantially parallel exterior end panels of said carton, further extensions of at least one of said panels comprising, when folded:

substantially parallel rectangular interior top panel and bottom panel; and a pair of rectangular interior end panels attached to the ends of said interior bottom panel and holding at least one of said interior top and bottom panels spaced apart from its corresponding exterior panel and each of said interior end panels forming an acute angle with respect 17 to said interior bottom panel.

2. The protection and support carton of claim 1 further comprising a pair of rectangular interior side panels for holding said interior bottom panel spaced apart from said exterior bottom panel.

3. The protection and support carton of claim 1 wherein said rectangular interior side panels further comprise means for holding both of said interior top and bottom panels spaced apart from their corresponding exterior panels.

4. The protection and support carton of claim 1 wherein the lateral dimension of said interior top panel between said interior end panels is shorter than the corresponding lateral dimension of said interior bottom panel.

5. The protection and support carton of claim 1 wherein all of said panels are formed by folding a single piece of corrugated cardboard.

6. The protection and support carton of claim 1 further comprising a pair of interior end panels formed by extensions of at least one of said interior top and bottom panels.

7. The protection and support carton of claim 1 further comprising a pair of interior end panels formed by lateral extensions of both of said interior top and bottom panels.

8. The protection and support carton of claim 7 wherein, at each end of said interior top and bottom panels, the lateral extension of said interior top panel is folded between the lateral extension of said interior bottom panel and the corresponding exterior end panel.

9. The protection and support carton of claim 8 wherein, at each end of said interior bottom panel, said acute angle is determined by said interior top panel and the lateral extension of said interior top panel and said interior end panel is wedged in position by the lateral extension of said interior bottom panel.

10. The protection and support carton of claim 9 wherein, at each end of said interior bottom panel, said acute angle is substantially forty degrees.

11. The protection and support carton of claim 8 wherein:

at each end of said interior top and bottom panels the extension of said interior top panel is folded between the extension of said interior bottom panel and the corresponding exterior end panel; and at each end of said interior bottom panel an extension thereof between said interior bottom panel and the corresponding interior end panel is folded under said interior bottom panel to hold said interior bottom panel apart from said exterior bottom panel.

12. The protection and support carton of claim 11 said carton is entirely formed by folding a single piece of corrugated cardboard.

13. The protection and support carton of claim 11 wherein, at each end of said interior top panel, a tab formed from the extension thereof holds said interior top panel apart from said exterior top panel.

14. The protection and support carton of claim 13 wherein said carton is entirely formed by folding a single piece of corrugated cardboard.

15. The protection and support carton of claim 8 wherein:

at each end of said interior top and bottom panels the extension of said interior top panel is folded between the extension of said interior bottom panel and the corresponding exterior end panel; and at each end of said interior bottom panel the ends of the extensions of both of said interior top and bottom panels hold said interior bottom panel apart from said exterior bottom panel.

16. The protection and support carton of claim 15 wherein said carton is entirely formed by folding a single piece of corrugated cardboard.

* * * * *